US011077667B2

(12) United States Patent
Noda et al.

(10) Patent No.: US 11,077,667 B2
(45) Date of Patent: Aug. 3, 2021

(54) LIQUID DISCHARGE APPARATUS AND IMAGE FORMING APPARATUS

(71) Applicants: Hiroshi Noda, Kanagawa (JP); Yuki Nagatsuka, Kanagawa (JP)

(72) Inventors: Hiroshi Noda, Kanagawa (JP); Yuki Nagatsuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/535,264

(22) Filed: Aug. 8, 2019

(65) Prior Publication Data

US 2020/0070524 A1 Mar. 5, 2020

(30) Foreign Application Priority Data

Aug. 31, 2018 (JP) ..... JP2018-163779

(51) Int. Cl.
*B41J 2/175* (2006.01)

(52) U.S. Cl.
CPC ..... *B41J 2/17509* (2013.01); *B41J 2/17523* (2013.01); *B41J 2/17566* (2013.01); *B41J 2/17596* (2013.01)

(58) Field of Classification Search
CPC .... B41J 2/17509; B41J 2/175; B41J 2/17596; B41J 2/17566; B41J 2/17523; B41J 2/18; B41J 2/19
See application file for complete search history.

(56) References Cited

U.S. PATENT DOCUMENTS

| | | | |
|---|---|---|---|
| 2005/0270318 | A1 | 12/2005 | Noda |
| 2007/0097163 | A1 | 5/2007 | Shingyohuchi et al. |
| 2013/0038650 | A1 | 2/2013 | Noda |
| 2013/0162718 | A1 | 6/2013 | Noda |
| 2013/0187985 | A1 | 7/2013 | Katoh et al. |
| 2014/0063121 | A1 | 3/2014 | Moriwaki et al. |
| 2014/0265106 | A1 | 9/2014 | Saitoh et al. |
| 2015/0158308 | A1 | 6/2015 | Kobayashi et al. |
| 2017/0057241 | A1* | 3/2017 | Ueda ..... B41J 2/17596 |

FOREIGN PATENT DOCUMENTS

| | | |
|---|---|---|
| JP | 2010-167732 | 8/2010 |
| JP | 2013-244682 | 12/2013 |

* cited by examiner

*Primary Examiner* — Scott A Richmond
(74) *Attorney, Agent, or Firm* — Oblon, McClelland, Maier & Neustadt, L.L.P.

(57) ABSTRACT

A liquid discharge apparatus includes a liquid discharge head configured to discharge a liquid, a sub tank configured to hold the liquid to supply the liquid to the liquid discharge head, a liquid cartridge configured to hold the liquid to be supplied to the sub tank, a supply channel configured to connect the sub tank and the liquid cartridge to supply the liquid from the liquid cartridge to the sub tank in a supply direction, a first channel opening-and-closing mechanism disposed in the supply channel to switch connection and disconnection of the supply channel, a second channel opening-and-closing mechanism disposed downstream of the first channel opening-and-closing mechanism in the supply direction in the supply channel, and circuitry configured to operate the first channel opening-and-closing mechanism to connect the supply channel, and operate the second channel opening-and-closing mechanism to feed the liquid from the liquid cartridge to the sub tank.

11 Claims, 8 Drawing Sheets

| PRESSURE [kPa] | AMOUNT OF MIXED AIR [cc] |
|---|---|
| 0 | 0 |
| −20 | 0.016 |
| −40 | 0.09 |

LIQUID DISCHARGE APPARATUS AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-163779, filed on Aug. 31, 2018 in the Japan Patent Office, the entire disclosures of which is hereby incorporated by reference herein.

BACKGROUND

Technical Field

Aspects of the present disclosure relate to a liquid discharge apparatus and an image forming apparatus.

Related Art

A liquid discharge apparatus discharges a liquid as a liquid droplet onto a medium to form an image on the medium. The liquid discharge apparatus separately includes a liquid holder and liquid holding container. The liquid holder holds the liquid to supply the liquid to a nozzle (discharge port) of a liquid discharge head that discharges the liquid from the nozzle. The liquid holding container holds the liquid to supply the liquid to the liquid holder. The liquid holder may be referred to as a sub tank, and the liquid holding container may be referred to as a main tank.

Such a liquid discharge apparatus device supplies the liquid from the main tank to the sub tank when the liquid is discharged from the nozzle and an amount of the liquid held in the sub tank decreases. Further, an image forming apparatus includes above-described liquid discharge apparatus to discharge a liquid as a liquid droplet onto a recording medium to form an image. The image forming apparatus is also referred to as an "inkjet printer".

The channel connecting the sub tank and the main tank for communication of liquid ink is provided inside a housing of the inkjet printer. The channel is desirably configured by a component that is easily routed in a space in the housing of the inkjet printer and is easy to assemble. Further, the channel is desirably constituted by a component easily replaceable for maintenance. Thus, the tube-shaped member having flexibility is used as components that configures a channel.

A liquid feed pump is disposed in the middle of a tube member that connects the sub tank and the main tank. Further, the inkjet printer includes a channel opening-and-closing mechanism that switches connection (communication) and disconnection (non-communication) of the channel disposed in the middle of the channel. For example, a tube made of resin is used as the tube-shaped member.

The sub tank includes a negative pressure generator in an internal structure of the sub tank. The sub tank often includes a film material (flexible film) made of a flexible material as the negative pressure generator of the sub tank.

When the resin tube or the flexible film as described above are used for a long time, air may gradually permeate and enter into the channel. Further, air may enter into the channel at the time of attachment or detachment of the main tank to the inkjet printer for replacing the main tank. Also, air existing inside the main tank may enter into the channel at the time of attachment or detachment of the main tank to the inkjet printer. There is also air dissolved in the ink. The air that has entered the channel eventually enters the interior of the sub tank and is accumulated in the sub tank. Thus, the degassing degree of the ink in the channel is lowered, and finally, a discharge failure of the liquid ink from the nozzles may be occurred.

Thus, in a configuration in which the channel connects the sub tank and the main tank, the gas barrier property of the tube constituting the channel has to be increased, and sealing property of connections between the tube and the main tank and the connection between the tube and the sub tank has to be increased. Increasing the gas barrier property of the tube and the sealing property of the connector increases the cost. Therefore, an air release port is provided to discharge the air to prevent air from entering into the channel and accumulating in the sub tank. The air release port is openably closable to open (connect) the interior of the liquid container to the atmosphere.

SUMMARY

In an aspect of this disclosure, a liquid discharge apparatus includes a liquid discharge head configured to discharge a liquid, a sub tank configured to hold the liquid to supply the liquid to the liquid discharge head, a liquid cartridge configured to hold the liquid to be supplied to the sub tank, a supply channel configured to connect the sub tank and the liquid cartridge to supply the liquid from the liquid cartridge to the sub tank in a supply direction, a first channel opening-and-closing mechanism disposed in the supply channel to switch connection and disconnection of the supply channel, a second channel opening-and-closing mechanism disposed downstream of the first channel opening-and-closing mechanism in the supply direction in the supply channel, and circuitry configured to operate the first channel opening-and-closing mechanism to connect the supply channel, operate the second channel opening-and-closing mechanism to feed the liquid from the liquid cartridge to the sub tank, stop an operation of the second channel opening-and-closing mechanism, and operate the first channel opening-and-closing mechanism to disconnect the supply channel.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
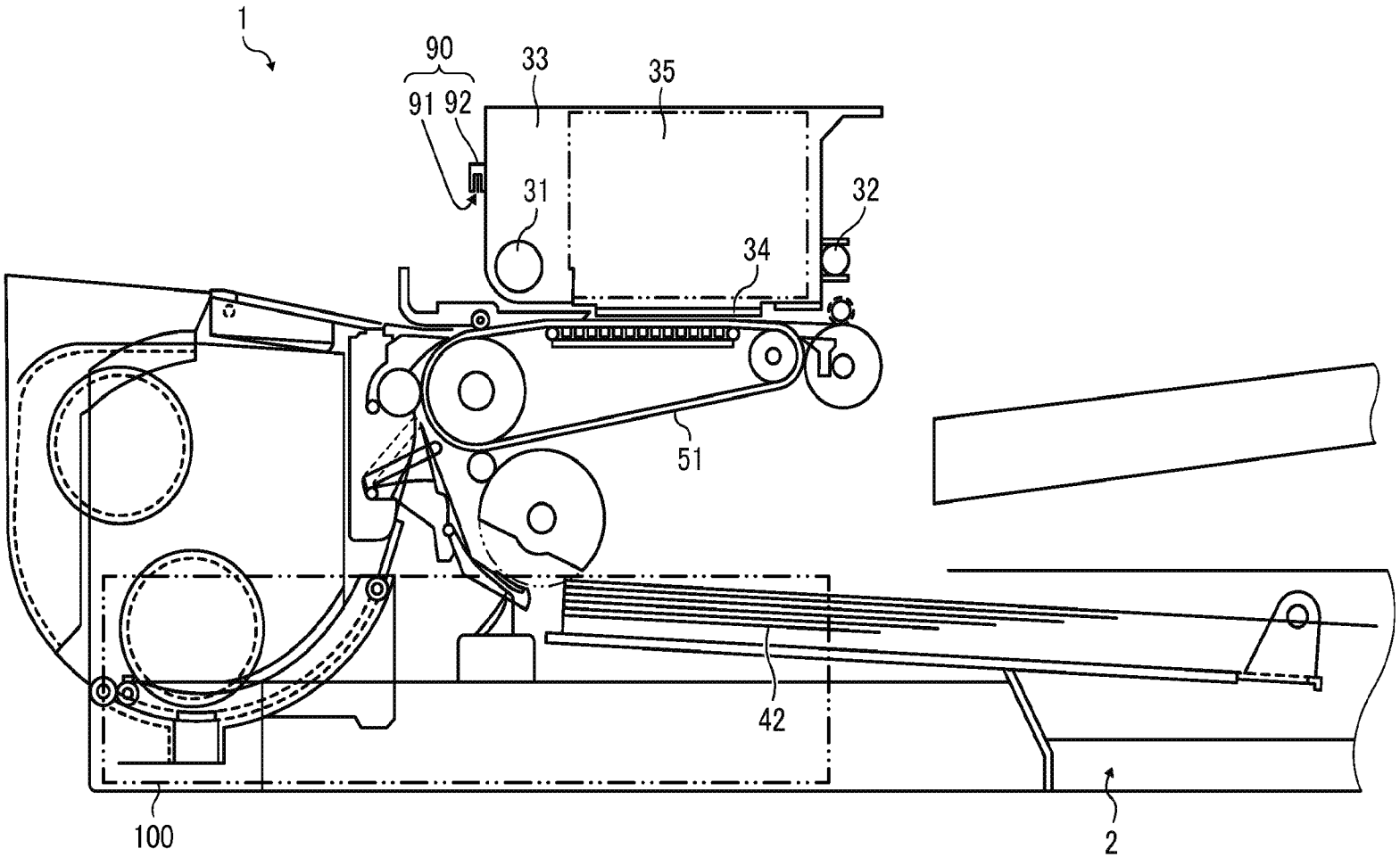
FIG. 1 is a schematic side view of an inkjet printer in an embodiment of an image forming apparatus according to the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of a liquid discharge apparatus according to the present disclosure is described with reference to the drawings. The embodiments described below are preferred embodiments of the present disclosure. Thus, various technically preferred embodiments may be added to the following embodiments. The embodiments described below are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. Although most preferable advantages are described below, advantages of the present disclosure are not limited to the advantages described below.

SUMMARY OF THE PRESENT DISCLOSURE

A liquid discharge apparatus according to the present disclosure controls timing of operating a valve in a channel to control a pressure in a channel and prevents air to be mixed into the channel. The valve can open and close the channel.

[Overall Configuration of Liquid Discharge Apparatus]

Figure 2:
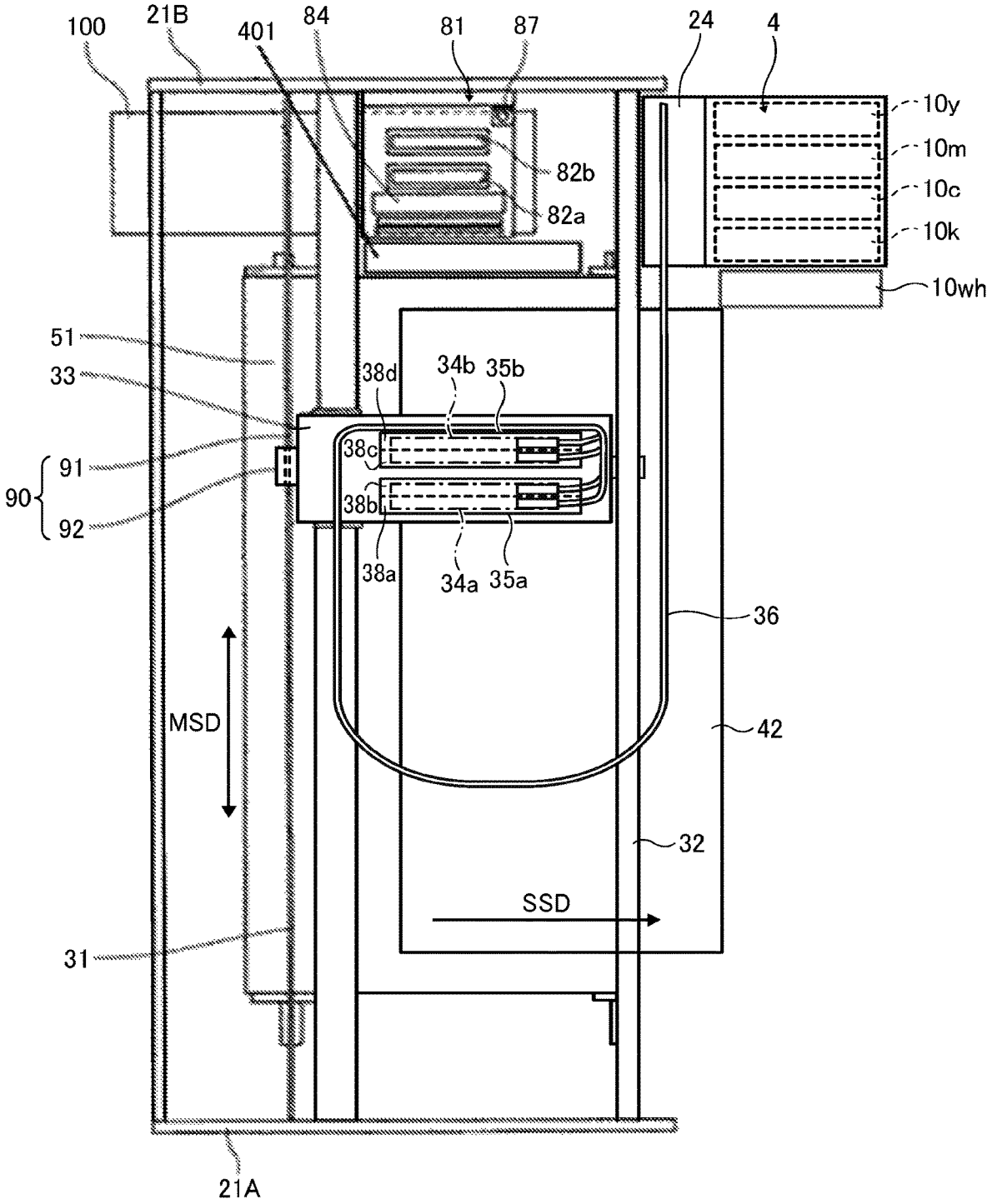
FIG. 2 is a schematic plan view of a portion of the inkjet printer according to the present disclosure.

Hereinafter, an overall configuration of an embodiment of an image forming apparatus including a liquid discharge apparatus according to the present disclosure is described with reference to FIGS. 1 and 2. FIG. 1 is a side view of an inkjet printer according to the present disclosure. FIG. 2 is a plan view of a main portion of the inkjet printer according to the present disclosure.

The inkjet printer 1 according to the present disclosure is a serial type inkjet recording apparatus. The inkjet printer is an example of the image forming apparatus. The inkjet printer 1 includes a carriage 33 held by a main guide rod 31 and a sub guide rod 32. The main guide rod 31 and the sub guide rod 32 are guide members that are laterally bridged between a left side plate 21A and a right-side plate 21B. The carriage 33 held by the main guide rod 31 and the sub guide rod 32 can slidably move along the main guide rod 31 and the sub guide rod 32 in a main scanning direction indicated by arrow "MSD" in FIG. 2. The inkjet printer 1 includes a main-scanning motor 554 described below to move and scan the carriage 33 in the main scanning direction MSD via a timing belt or a linear guide.

The carriage 33 mounts a recording head 34. Hereinafter, the "recording head 34" is simply referred to as the "head 34". The head 34 is a liquid discharge head including a nozzle (discharge port) to discharging a liquid. The head 34 moves and scans in the main scanning direction MSD with a sliding movement of the carriage 33 in the main scanning direction MSD. In FIG. 2, the carriage 33 mounts two heads 34*a* and 34*b* (see FIG. 2), for example. The heads 34*a* and 34*b* includes nozzle arrays including nozzles to discharge ink droplets (liquids) of respective colors of yellow (Y), cyan (C), magenta (M), and black (Bk), white (Wh), and silver (Si). The nozzle array serves as a discharge port of the ink droplet. The nozzle array is arranged in a sub-scanning direction orthogonal to the main scanning direction MSD. The sub-scanning direction is indicated by SSD in FIG. 2. The nozzle array is directed downward to a recording medium (sheet 42) onto which ink liquids of each color are discharged.

Further, two sub tanks 35*a* and 35*b* are mounted on the carriage 33. Hereinafter, the sub tanks 35*a* and 35*b* are collectively referred to as the "sub tank 35". The sub tank 35 is a liquid holder that holds liquid ink of each colors to supply the liquid ink of each colors corresponding to the nozzle arrays of the heads 34. The liquid ink held in the sub tank 35 is consumed while the liquid ink is discharged from the nozzles. Thus, it is necessary to supply the liquid ink to the sub tank 35 when an amount of the liquid ink in the sub tank 35 becomes less than a predetermined amount. The liquid ink of each colors is supplied to the sub tank 35 from a liquid cartridge serving as the main tank through a tube 36 of a supply channel 43.

The liquid cartridge according to the present disclosure includes ink cartridges 10*y*, 10*m*, 10*c*, 10*k*, 10*wh*, or 10Si. Hereinafter, the ink cartridges 10*y*, 10*m*, 10*c*, 10*k*, 10*wh*, or 10Si may be collectively referred to as "ink cartridge 10". In FIG. 2, the inkjet printer 1 includes five ink cartridges 10*y*, 10*m*, 10*c*, 10*k* and 10*wh*. The inkjet printer 1 includes a pump unit 24 detachably mounted to the cartridge loading unit 4. The pump unit 24 supplies the liquid ink from the ink cartridge 10 to the sub tank 35.

Liquid ink of each colors is supplied from the ink cartridges 10*y*, 10*m*, 10*c*, 10*k*, 10*wh*, and 10Si to ink containers 38 of the sub tanks 35 corresponding to the ink cartridges 10 of each colors via the tube 36 of the supply channel 43. In FIG. 2, the sub tank 35*a* includes ink containers 38*a* and 38*b*, and the sub tank 35*b* includes ink containers 38*c* and 38*d*. Each ink containers 38*a* to 38*d* contains different types of colors. Hereinafter, the ink containers 38*a* to 38*d* are collectively referred to as the "ink container 38".

The inkjet printer 1 includes an encoder scale 91 disposed along the main scanning direction MSD of the carriage 33. The carriage 33 includes an encoder sensor 92 that reads the encoder scale 91. The encoder scale 91 and the encoder sensor 92 constitute a linear encoder 90. A main scanning position (carriage position) and an amount of movement of the carriage 33 are detected by a detection signal of the linear encoder 90.

Further, a maintenance unit 81 maintains and recovers a discharge function of the nozzles of the head 34. The maintenance unit 81 is disposed in a non-printing area on one side of the carriage 33 in the main scanning direction MSD. The maintenance unit 81 includes caps 82*a* and 82*b*, a wiper 401, a dummy discharge receptacle 84, and a carriage lock 87.

Each of the heads 34*a* and 34*b* includes a nozzle surface on which the nozzle array is formed. The caps 82*a* and 82*b* cap nozzle surfaces of the heads 34*a* and 32*b*, respectively. The inkjet printer 1 according to the present disclosure includes two caps 82*a* and 82*b* to cap two heads 34*a* and 34*b* corresponding to two caps 82*a* and 82*b*, respectively. The caps 82*a* and 82*b* cap the nozzle surfaces to maintain the nozzles humid and suction thickened liquid ink from the nozzles to recover the discharge function of the nozzles (nozzle suction operation). The wiper 401 wipes the liquid ink adhered to the nozzle surface (wiping operation). The nozzles (discharge ports) are formed on the nozzle surface of the head 34. The dummy discharge receptacle 84 receives liquid inks when a dummy discharge operation is performed.

The dummy discharge operation discharges the liquid inks that do not contribute to recording (image forming) on a recording medium to discharge thickened recording liquid (liquid ink) to recover the discharge function of the nozzles of the head 34. The carriage lock 87 is used to lock (fix) an operation of the carriage 33.

The inkjet printer 1 includes a waste liquid tank 100 to accommodate a waste liquid generated by a maintenance operation on a lower side of the maintenance unit 81. The maintenance operation includes capping and suctioning of the nozzle surface, wiping of the nozzle surface, and the dummy discharge operation. The waste liquid tank 100 is replaceably attached to a housing of the inkjet printer 1.

[Printing and Maintenance Operations of Inkjet Printer 1]

Next, a printing operation (recording operation) and a maintenance operation of the inkjet printer 1 is described below. The inkjet printer 1 drives the heads 34 according to an image signal while moving the carriage 33 to discharge liquid inks onto the stopped sheet 42 to record one line and conveys the sheet 42 by a predetermined amount to record next line. The inkjet printer 1 ends the recording operation when the inkjet printer 1 receives a signal indicating an end of recording or a signal indicating that a rear end of the sheet 42 reaches a recording area. Then, the inkjet printer 1 eject the sheet 42 outside the housing of the inkjet printer 1.

To maintain the nozzle array of the head 34 in a preferable state or to recover the nozzle array of the head 34 to a preferable state, the inkjet printer 1 moves the carriage 33 to a position facing to the maintenance unit 81 that is a home position of the carriage 33. Further, the inkjet printer 1 caps the nozzle surface of the head 34 with the cap 82 and performs the nozzle suction operation on each nozzles of the nozzle array. The inkjet printer 1 may also perform the dummy discharge operation to discharge the liquid inks not contributing to image formation to remove the thickened ink that clogs the nozzles from the nozzles to prevent discharge failure. The maintenance operation includes the nozzle suction operation and the dummy discharge operation. The maintenance operation is performed to enable a stable liquid discharge and a stable image formation.

[Structure of Sub Tank 35]

Figure 3:
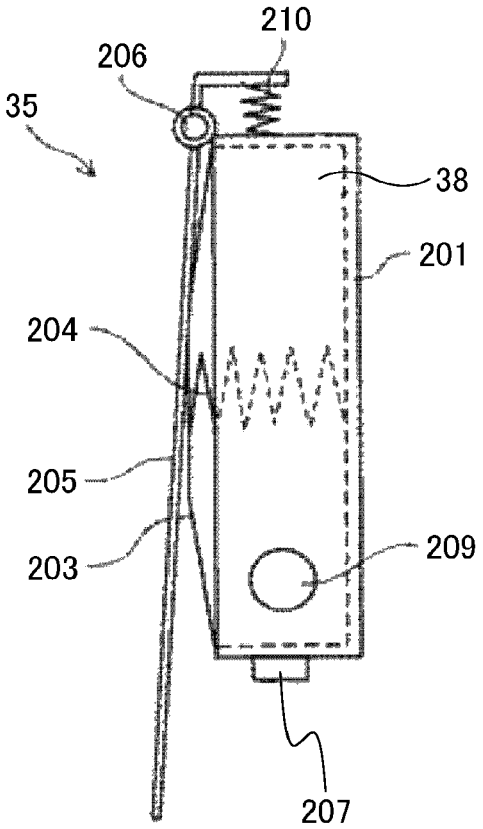
FIG. 3 is a schematic plan view of a sub tank in the inkjet printer according to the present disclosure.

Next, an example of a structure of the sub tank 35 is described with reference to FIGS. 3 and 5. FIG. 3 is a schematic top view of the sub tank 35 for one nozzle array.

The sub tank 35 includes a tank case 201 opened at one side to hold the liquid ink. The sub tank 35 includes an opening of the tank case 201 sealed with a flexible film 203 serving as a flexible member. The tank case 201 and the flexible film 203 form the ink container 38. The flexible film 203 is always urged outward by a spring 204 as an elastic member disposed in the tank case 201. When the amount of ink remaining in the ink container 38 in the tank case 201 is reduced by an action of a biasing force of the spring 204 on the flexible film 203, a pressure inside the ink container 38 becomes negative.

Further, the sub tank 35 includes a feeler 205 disposed outside the tank case 201. One end (upper end in FIG. 3) of the feeler 205 is supported by a support shaft 206, and a central portion of the feeler 205 is fixed to a flexible film 203 by an adhesive or the like. Thus, another end (lower end in FIG. 3) of the feeler 205 is swingable around the support shaft 206. The one end (upper end in FIG. 3) of the feeler 205 is biased by a spring 210 fixed to one end of the tank case 201 so that another end (lower end in FIG. 3) of the feeler 205 approaches the tank case 201. The biasing force of the spring 204 enable the feeler 205 to be displaced according to a movement of the flexible film 203.

The inkjet printer 1 includes a sensor 301 (detector) on the carriage 33. The sensor 301 detects a displacement of the feeler 205 to detect an amount of liquid ink remaining in the sub tank 35, the negative pressure in the sub tank 35, and the like. The sensor 301 may be provided on an apparatus body of the inkjet printer 1 to face and detect the feeler 205.

Further, the sub tank 35 includes an inlet 209 on an upper portion of the tank case 201. The liquid ink supplied from the ink cartridges 10 is flown into the ink container 38 of the sub tank 35 from the inlet 209. One end of the tube 36 of the supply channel 43 (see FIG. 2) is connected to the inlet 209 (see FIGS. 3 and 5). Another end of the tube 36 of the supply channel 43 is connected to a liquid feed pump 241 that constitutes the pump unit 24 (see FIGS. 2 and 5).

Further, the sub tank 35 includes an outlet 207 on another end of the tank case 201 opposite to the one end of the tank case 201 to which the spring 210 is fixed. The outlet 207 is used to circulate the liquid ink in the ink container 38 of the sub tank 35. As illustrated in FIG. 5, one end of a tube 37 of a circulation channel 45 is connected to the outlet 207, and another end of the tube 37 of the circulation channel 45 is connected to the tube 36 of the supply channel 43 at a position between the ink cartridge 10 and the liquid feed pump 241. The tubes 36 of the supply channel 43 and the tubes 37 of the circulation channel 45 constitute a channel 40 of the present disclosure.

[Negative-Pressure Forming Operation in Sub Tank 35]

Figure 4A:
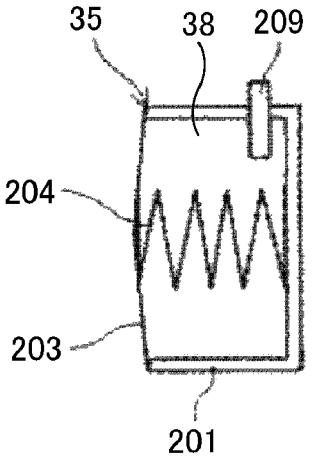
FIGS. 4A and 4B are side views of the sub tank in an operation state according to the present disclosure.

A negative-pressure forming operation in the ink container 38 of the sub tank in the inkjet printer 1 is described with reference to FIG. 4. FIGS. 4A and 4B are schematic side views of the sub tank 35 in a state after the liquid ink is supplied to the sub tank 35 from the ink cartridge 10. FIG. 4A illustrates a state in which the ink container 38 of the sub tank 35 is filled with the liquid ink. Therefore, the flexible film 203 that forms one side surface of the tank case 201 (ink container 38) expands outward by the liquid ink filled in the ink container 38 of the sub tank 35.

Figure 4B:
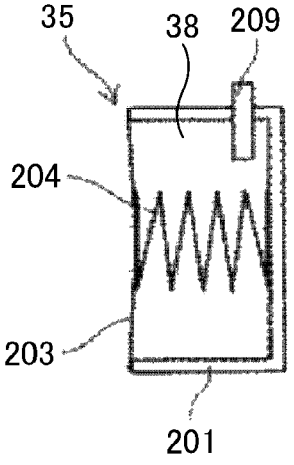

When the nozzle suction operation or the dummy discharge operation is performed after the ink container 38 is filled with liquid ink as illustrated in FIG. 4A, the amount of liquid ink in the ink container 38 decreases to a state as illustrated in FIG. 4B. As illustrated in FIG. 4B, the liquid ink in the ink container 38 decreases to generate a negative pressure in the ink container 38. Thus, the flexible film 203 is displaced inward of the sub tank 35 against the biasing force of the spring 204 in FIG. 4B.

Further, when the liquid feed pump 241 (see FIGS. 5 and 6) is operated to suck the interior of the ink container 38, the flexible film 203 is drawn inward the ink container 38 so that the spring 204 is further compressed to increase the negative pressure. The liquid feed pump 241 can feed the liquid ink in both directions from the ink cartridge 10 to the sub tank 35 and from the sub tank 35 to the ink cartridge 10.

When the liquid ink is supplied to the ink container 38 from the above-described state, the flexible film 203 is pushed outward (leftward in FIG. 4A) of the sub tank 35 by the supplied liquid ink, so that the spring 204 expands to decrease the negative pressures in the ink container 38. Thus, the inkjet printer 1 repeats the above-described negative-pressure forming operation to control and maintain the negative pressure in the ink containers 38 of each colors in each of the sub tanks 35 to be constant.

[Configuration of Channel]

Next, a configuration of the channel 40 in the inkjet printer 1 to circulate the liquid ink is described with reference to FIG. 5. FIG. 5 is a schematic circuit diagram of the channel 40 related to the ink container 38 in the sub tank 35 that contains a liquid ink of a certain color. As described above, the sub tank 35 of the inkjet printer 1 includes the ink containers 38 corresponding to each of the six colors of liquid inks. Each ink containers 38 may include the channel 40 having a similar configuration with the configuration of the channel 40 as described below. Further, the ink containers 38 corresponding to some of colors of the liquid inks may include the channel 40 having a configuration different from the configuration of the channel 40 as described below.

The inkjet printer 1 according to the present disclosure includes the channel 40 that includes the supply channel 43 and the circulation channel 45. The supply channel 43 supplies liquid ink from the ink cartridge 10 to the sub tank 35. The circulation channel 45 feeds the liquid ink from the sub tank 35 to the ink cartridges 10 to circulate the liquid ink in the sub tank 35.

The supply channel 43 includes the liquid feed pump 241, the tubes 36, and a supply solenoid 303. The tubes 36 connects the ink cartridge 10 and the liquid feed pump 241 and connects the liquid feed pump 241 and the sub tank 35. The supply solenoid 303 is disposed on the tube 36 at a position between the ink cartridge 10 and the liquid feed pump 241. The supply solenoid 303 serves as a first channel opening-and-closing mechanism that switches connection and disconnection of the supply channel 43. The supply solenoid 303 as the first channel opening-and-closing mechanism prevents a rapid surge of a pressure in the channel 40 of the inkjet printer 1. The liquid feed pump 241 severs as a second channel opening-and-closing mechanism.

The circulation channel 45 includes tubes 37 and a circulation solenoid 302. One end of the tube 37 is connected to the outlet 207 of the sub tank 305 and another end of the tube 37 is connected to the tube 36 at a position between the ink cartridge 10 and the liquid feed pump 241. The circulation solenoid 302 is disposed on the tube 37 at a position between the outlet 207 of the sub tank 305 and another end of the tube 37 connected to the tube 36 at the position between the ink cartridge 10 and the liquid feed pump 241. The circulation solenoid 302 serves as a third channel opening-and-closing mechanism.

The liquid feed pump 241 is a reversible pump formed of a tube pump or the like. The liquid feed pump 241 is disposed on the tube 36 of the supply channel 43 at a position between inlet 209 of the sub tank 35 and the supply solenoid 303. That is, the liquid feed pump 241 is disposed downstream of the supply solenoid 303 on the supply channel 43 in a flow direction of the liquid ink from the ink cartridge 10 to the sub tank 35. The liquid feed pump 241 is used for a supply operation that supplies the liquid ink from the ink cartridges 10 to the sub tank 35. Further, the liquid feed pump 241 is also used for a circulation operation that causes the liquid ink to flow from the sub tank 35 and returns to the sub tank 35 again.

The tube 36 constitutes the supply channel 43 as described above. The supply channel 43 connects the sub tank 35 of the head 34 and the ink cartridge 10 serving as the main tank. The tube 37 constitutes the circulation channel 45 as described above. The circulation channel 45 circulates the liquid ink in the sub tank 35. The tube 36 is desirably a flexible member as described above, and a tube made of resin is used, for example.

The maintenance unit 81 (see FIGS. 2 and 5) includes the suction cap 82*a* to cap the nozzle surface of the head 34 as described above and a suction pump 221 connected to the suction cap 82*a*. The inkjet printer 1 drives the suction pump 221 while capping the nozzle surface with the suction cap 82*a* to vacuum the liquid ink from the nozzle through the suction cap 82*a* and the suction tube 220 so that the liquid ink in the sub tank 35 can be suctioned. The sucked waste ink is discharged to the waste liquid tank 100.

Figure 5:
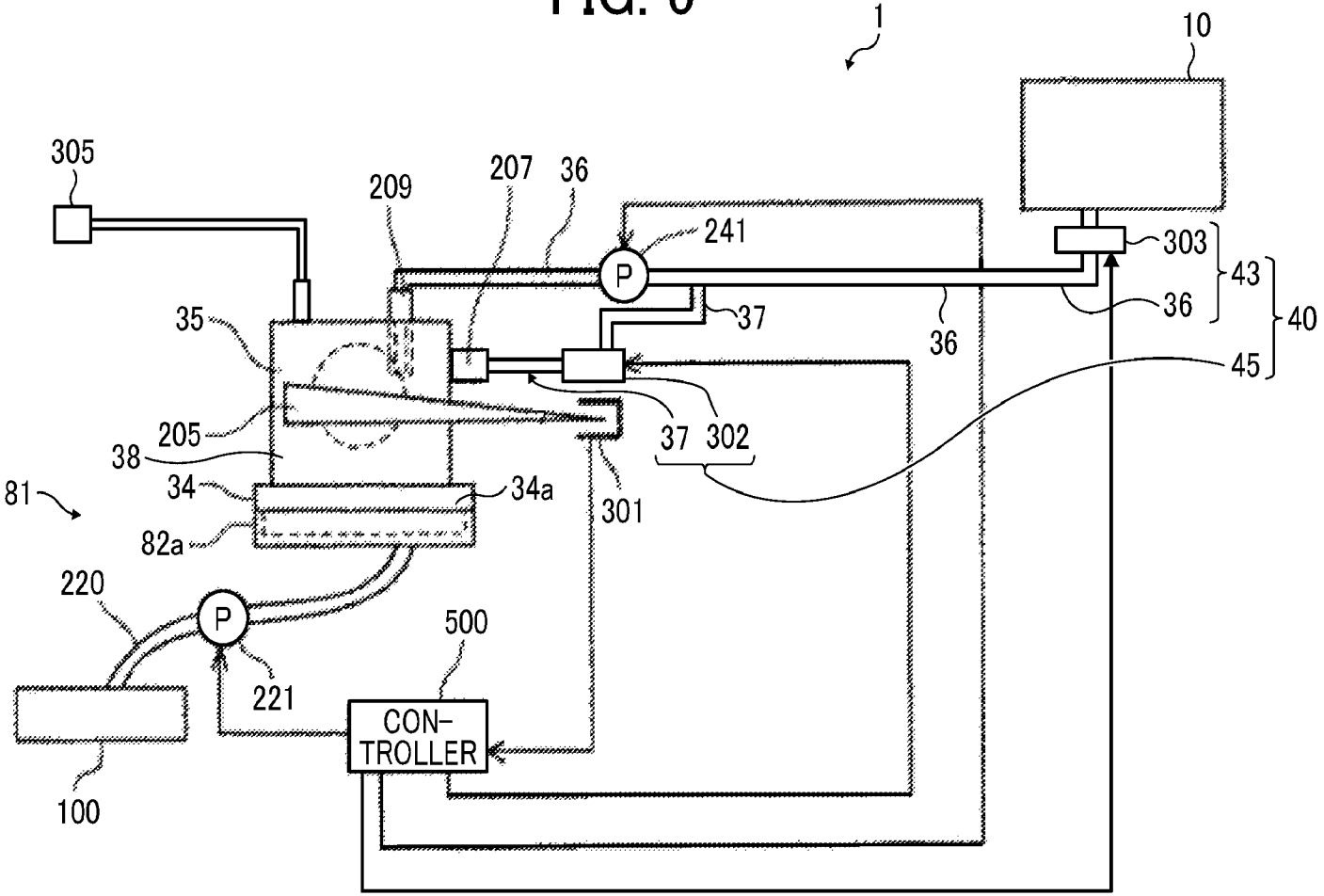
FIG. 5 is a circuit diagram of a channel in the inkjet printer according to the present disclosure.

As illustrated in FIG. 5, the inkjet printer 1 includes a sensor 301 made of an optical sensor. The sensor 301 is a detector to detect the feeler 205 on the carriage 33 (see FIGS. 2 to 5). The inkjet printer 1 uses detection result of the sensor 301 to control an ink supply operation to supply the liquid ink from the ink cartridge 10 to the sub tank 35. That is, the inkjet printer 1 includes a controller 500 to control an ink supply operation of the inkjet printer 1. Specifically, the controller 500 detects an amount of liquid ink held in the sub tank 35 based on a detection result of the sensor 301 and supplies the liquid ink to the sub tank 35 when the controller 500 detects that the amount of liquid ink in the sub tank 35 is lower than a predetermined amount.

The supply solenoid 303 is disposed in the supply channel 43 to supply the liquid ink from the ink cartridge 10 as the main tank to the sub tank 35. The supply solenoid 303 opens and closes the supply channel 43 to connect (communication) or disconnect (non-communication) the supply channel 43 between the ink cartridges 10 and the sub tank 35. The controller 500 controls an operation and operation timing of the supply solenoid 303.

The circulation channel 45 is connected to the ink container 38 for the white ink (Wh) or the silver ink (Si) in which the precipitation of compounds in the liquid ink easily occurs. The circulation channel 45 may not be provided for the ink container 38 of other colors.

The circulation solenoid 302 serves as a third channel opening-and-closing mechanism constitutes the circulation channel 45 together with the tubes 37. The circulation solenoid 302 is disposed between the outlet 207 connected to the ink container 38 of the sub tank 35 and the ink cartridges 10. Specifically, the circulation solenoid 302 is connected to the tube 36 of the supply channel 43 with the tube 37 at a position between the liquid feed pump 241 and the ink cartridges 10, that is a position upstream of the liquid feed pump 241 in a flow direction of the liquid ink from the ink cartridge 10 to the sub tank 35. The controller 500 operates the circulation solenoid 302 to switch connection or disconnection of the circulation channel 45. The controller 500 controls an operation and operation timing of the circulation solenoid 302.

To circulate the liquid ink held in the ink container 38 of the sub tank 35, the controller 500 operates the circulation solenoid 302 serving as the third channel opening-and-closing mechanism to connect the circulation channel 45 to feed the liquid ink from the ink container 38 of the sub tank 35 back to the ink cartridge 10. Further, the controller 500 operates the supply solenoid 303 serving as the first channel opening-and-closing mechanism to disconnect (close) the supply channel 43 from the ink cartridges 10 to the ink container 38 of the sub tank 35 to disconnect the supply channel 43.

In a disconnection state of the supply channel 43, the controller 500 drives the liquid feed pump 241 serving as the second channel opening-and-closing mechanism to feed the liquid ink in the ink container 38 of the sub tank 35 toward the ink cartridge 10 to circulate the liquid ink in the sub tank 35. Here, the liquid ink is not fed back to the ink cartridges 10 because the supply solenoid 303 disconnect the supply channel 43 to the ink cartridges 10. The circulation operation is periodically performed when the image forming operation in the inkjet printer 1 is not performed.

When the circulation operation is not performed, the controller 500 operates the circulation solenoid 302 to disconnect (close) the circulation channel 45 from the ink container 38 of the sub tank 35 to the ink cartridge 10. The circulation channel 45 includes the tube 37 that connects the outlet 207 of the sub tank 35 and the tube 36 at a position between the liquid feed pump 241 and the ink cartridge 10. In a disconnection state of the circulation channel 45, the controller 500 drives the supply solenoid 303 serving as the first supply opening-and-closing mechanism to connect (open) the supply channel 43 from the ink cartridge 10 to the ink container 38 of the sub tank 35 and further drives the liquid feed pump 241 to supply the liquid ink from the ink cartridge 10 to the sub tank 35.

[Configuration of Controller 500]

Figure 6:
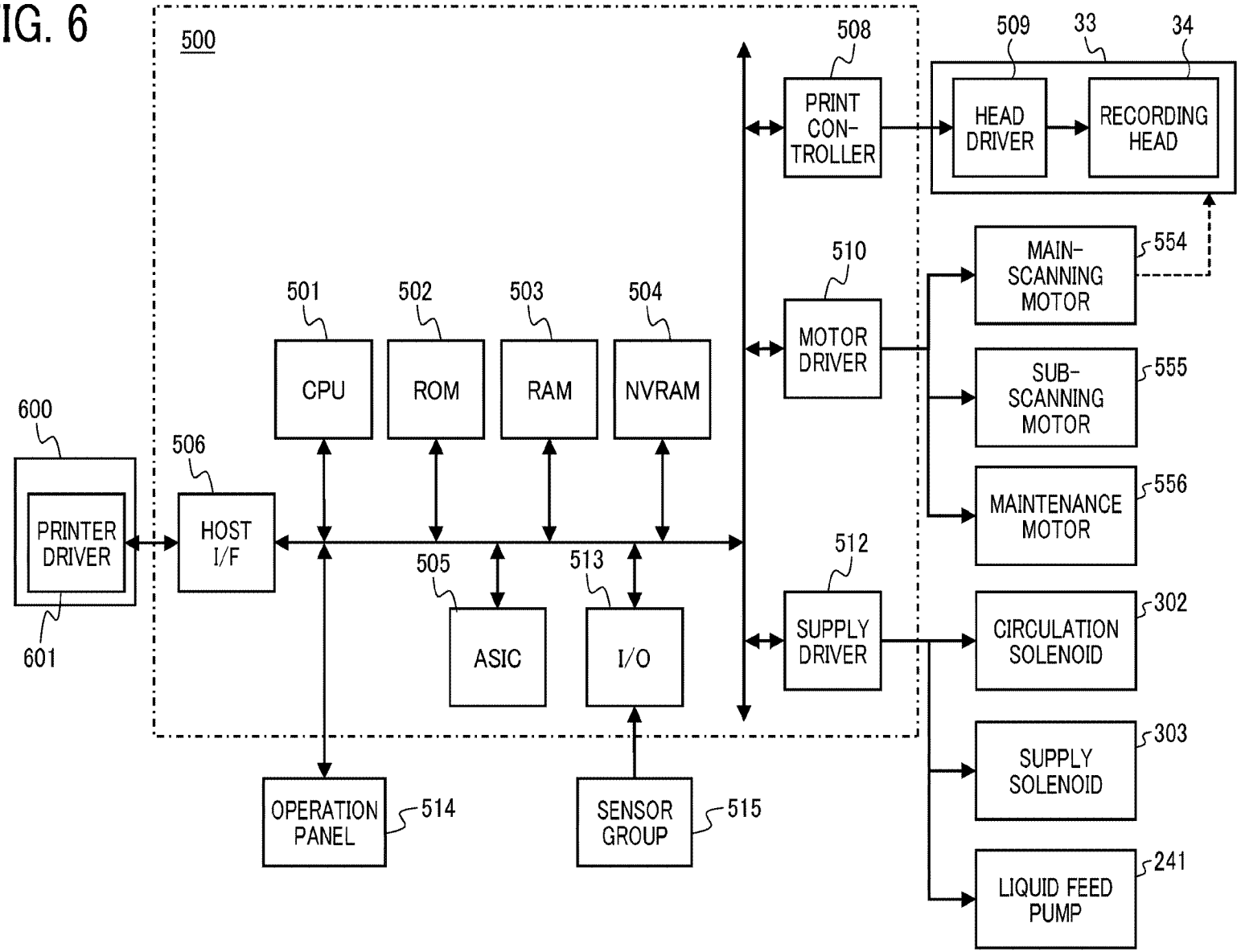
FIG. 6 is a functional block diagram of a controller in the inkjet printer according to the present disclosure.

Next, the configuration of the controller 500 that controls the operation of the inkjet printer 1 is described with reference to FIG. 6. FIG. 6 is a block diagram of the controller 500 of the inkjet printer 1 according to an embodiment of the present disclosure. The controller 500 controls the drive control of the liquid feed pump 241, the circulation solenoid 302, the supply solenoid 303, and the suction pump 221 described in FIG. 5 and the ink supply operation and the ink circulation operation in the inkjet printer 1.

The controller 500 includes a central processing unit (CPU) 501, a read only memory (ROM), a random-access memory (RAM) 503, a non-volatile random-access memory (NVRAM) 504, and an application-specific integrated circuit (ASIC) 505. The CPU 501 serves as a various control means such as ink supply controller according to the present disclosure. The ROM 12 stores a program executed by the CPU 501 and other fixed data. The NVRAM 504 is a non-volatile memory (NVRAM) that is reprogrammable to hold the data even a power supply of the inkjet printer 1 is cutoff. The ASIC 505 executes various signal processing for image data, image processing such as rearrangement, and input and output signal processing to control the overall apparatus.

Each of the functions of the controller 500 in the present disclosure may be implemented by one or more processing circuits or circuitry such as CPU 501. Processing circuitry includes a programmed processor, as a processor includes circuitry.

The controller 500 further includes a print controller 508 and a head driver 509. The print controller 508 includes a data transmitter and a driving signal generator to drive and control the head 34. The head driver 509 drives the head 34 mounted on the carriage 33. The head driver 509 is configured by a driver integrated circuit (driver IC). The controller 500 further includes a motor driver 510 that drives a main-scanning motor 554, a sub-scanning motor 555, and a maintenance motor 556.

The main-scanning motor 554 moves and scans the carriage 33. The sub-scanning motor 555 moves the peripheral surface of a conveyance belt 51. The maintenance motor 556 moves the caps 82*a* and 82*b* and the wiper 401 of the maintenance unit 81. The controller 500 further includes a supply driver 512 to drive the circulation solenoid 302, the supply solenoid 303, and the liquid feed pump 241.

Further, the inkjet printer 1 includes an operation panel 514 connected to the controller 500. The operation panel 514 inputs and displays information necessary for the operation of the inkjet printer 1.

The controller 500 also includes a host interface (I/F) 506 to send and receive data and signals to and from a host 600. The controller 500 receives data and signals by the host I/F 506 from the host 600, such as an information processing apparatus (e.g., a personal computer), an image reading device such as image scanner, or an imaging device such as digital camera, via a cable or network.

The CPU 501 of the controller 500 reads out and analyzes print data in a reception buffer included in the host I/F 506, performs necessary image processing, data rearrangement processing, and the like by the ASIC 505, and transfers the image data from the print controller 508 to the head driver 509. The printer driver 601 on the host 600 generates dot pattern data to output an image.

The print controller 508 transfers the above-described image data as serial data, and outputs a transfer clock, a latch signal, a control signal, and the like necessary for transferring the image data and determining the transfer to the head driver 509. The print controller 508 also includes a drive signal generation unit configured by a digital/analog (D/A) converter, a voltage amplifier, a current amplifier, and the like that D/A converts the pattern data of the drive pulse stored in the ROM 502. The drive signal generation unit generates a drive signal composed of one drive pulse or a plurality of drive pulses, and outputs the drive signal to the head driver 509.

In accordance with serially-inputted image data corresponding to one line recorded by the heads 34, the head driver 509 selects drive pulses of a driving signal transmitted from the print controller 508 and applies the selected drive pulses to a drive element (piezoelectric element, etc.) to drive the head 34. The head 34 includes the drive element that generates energy to discharge a liquid from the head 34. At the time of driving the drive element, the controller 500 selects a drive pulse that constitutes a drive signal to separately discharge dots of different sizes, such as large drop, medium drop, and small drop, for example.

An I/O unit 513 acquires information from various types of sensors of the sensor group 515 mounted on the inkjet printer 1, extracts information necessary for controlling the inkjet printer 1, and uses extracted data to control the print controller 508, the motor driver 510, and the supply driver 512 to control the ink supply operation to the sub tank 35, for example.

The sensor group 515 includes an optical sensor to detect a position of the sheet 42, a thermistor (environmental temperature sensor or environmental humidity sensor) to monitor temperature or humidity of the housing of the inkjet printer 1, and an interlock switch to detect opening and closing of a cover, for example. The I/O unit 513 processes the information from various sensors of the sensor group 515.

[Drive Timing of Channel Opening-and-Closing Mechanism at Time of Ink Supply]

Figure 7:
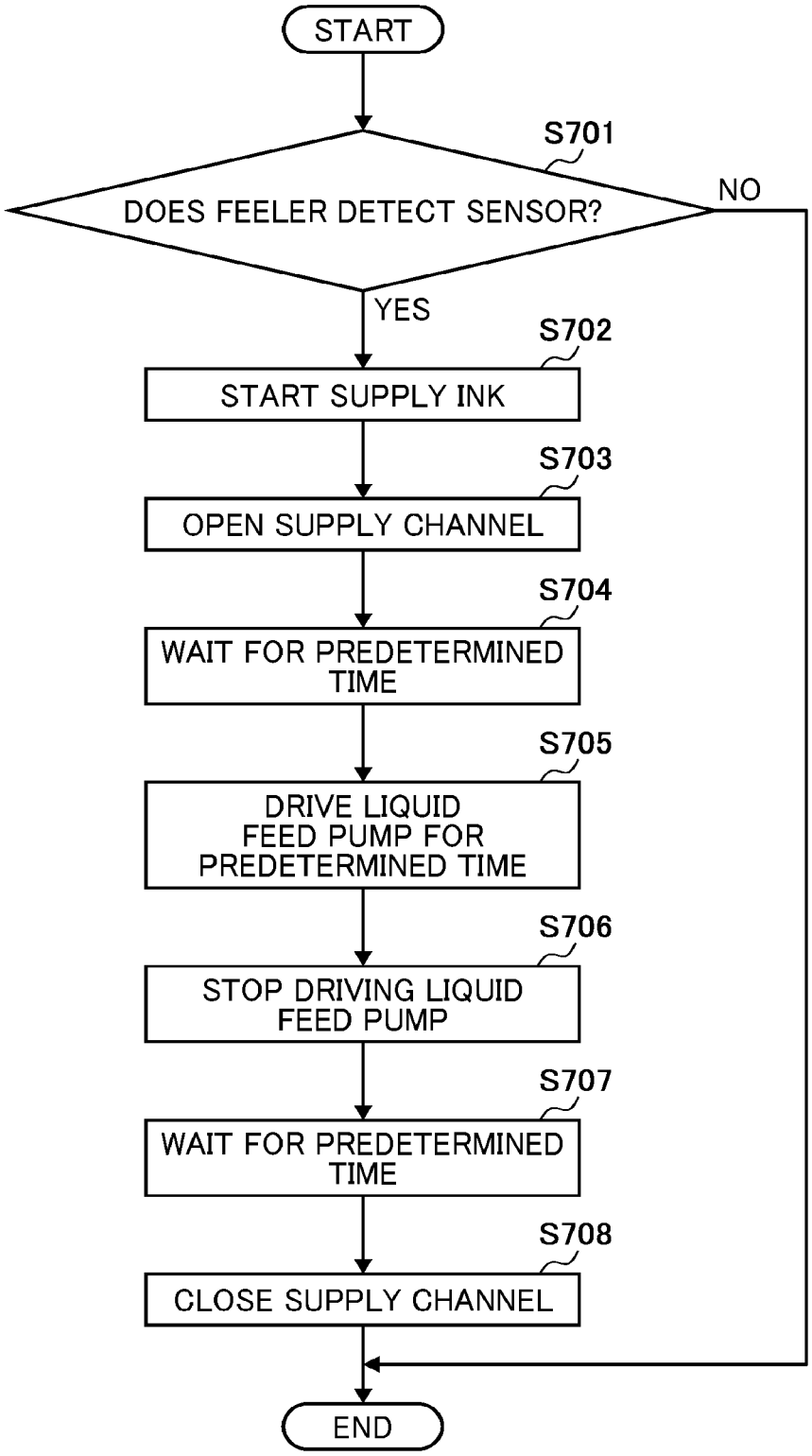
FIG. 7 is a flowchart of a control flow of a channel opening-and-closing mechanism at time of a supply operation in the inkjet printer according to the present disclosure.

Next, an example of control of a channel opening-and-closing mechanism in the inkjet printer 1 including the above-described configuration is described using a flowchart in FIG. 7. FIG. 7 is a flowchart illustrating a flow of operation of the channel opening-and-closing mechanism at the time of printing operation in the inkjet printer 1.

When the inkjet printer 1 starts a printing operation (image forming operation), the liquid ink held in the ink container 38 in the sub tank 35 is discharged from the head 34, and the amount of the liquid ink in the ink container 38 decreases. The controller 500 determine whether the sensor 301 detects the feeler 205 to determine whether an amount of the liquid ink held in the ink container 38 is below a predetermined amount (S701).

If the sensor 301 does not detect the feeler 205, the liquid ink in the ink container 38 is larger than the predetermined amount. Thus, the controller 500 ends the present operations (NO in S701). When the sensor 301 detects the feeler 205, the liquid ink in the ink container 38 is below the predetermined amount (YES in S701), and the controller 500 thus starts supplying the liquid ink from the ink cartridge 10 to the sub tank 35 (S702).

When the controller 500 control to start supplying the liquid ink from the ink cartridge 10 to the ink container 38, the controller 500 first operates the supply solenoid 303 serving as a first channel opening-and-closing mechanism to connect (open) the supply channel 43. It takes a certain amount of time from the operation of the supply solenoid 303 to a complete connection (communication or opening) of the supply channel 43 (S703).

Then, the controller 500 waits for predetermined time until a predetermined first waiting time has elapsed (S704). Details of the first waiting time is described below.

After the first waiting time has elapsed, the controller 500 starts driving the liquid feed pump 241 to drive the liquid feed pump 241 for a predetermined time (S705). The liquid feed pump 241 is driven to supply the liquid ink from the ink cartridge 10 to the ink container 38 of the sub tank 35. The controller 500 drives the liquid feed pump 241 for the predetermined time and then stops driving the liquid feed pump 241 (S706).

Then, the controller 500 waits for a predetermined time until a predetermined second waiting time has elapsed (S707). Details of the second waiting time is described below.

After the second waiting time has elapsed, the controller 500 operates the supply solenoid 303 to disconnect (close) the supply channel 43 between the ink cartridge 10 and the ink container 38 (S708).

A control of stopping the liquid feed pump 241 in the step S706 is not necessarily be limited to be executed after the predetermined time has elapsed. For example, the inkjet printer 1 may include a pressure sensor that detects an internal pressure of the supply channel 43. The controller 500 may stop the liquid feed pump 241 at timing when a pressure detected by the pressure sensor becomes equal to or less than a predetermined value.

[Drive Timing of Channel Opening-and-Closing Mechanism at Time of Ink Circulation]

Figure 8:
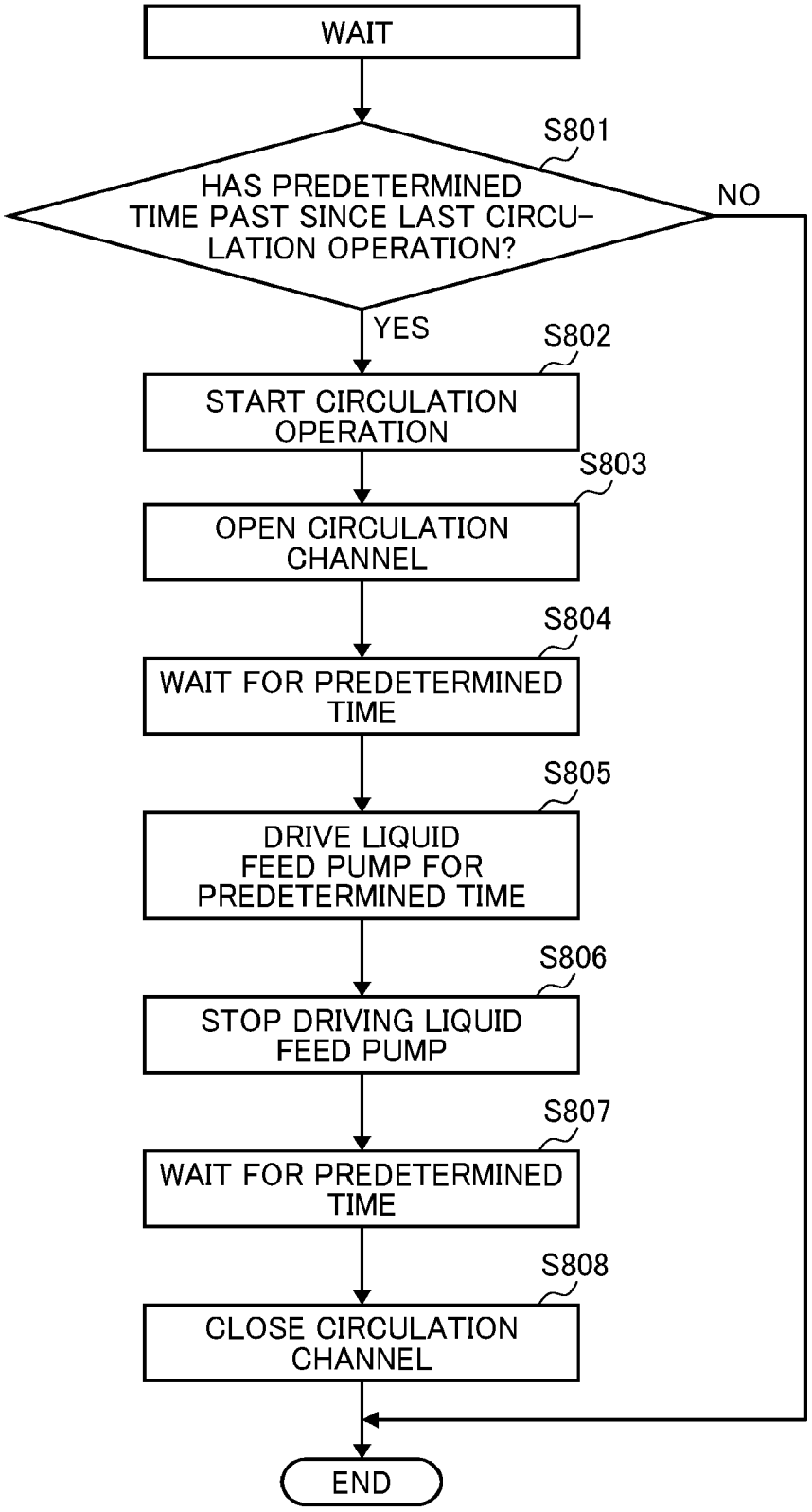
FIG. 8 is a flowchart of a control flow of a channel opening-and-closing mechanism at time of a circulation operation in the inkjet printer according to the present disclosure.

Next, another example of control of the channel opening-and-closing mechanism in the inkjet printer 1 including the above-described configuration is described below using the flowchart of FIG. 8. FIG. 8 is a flowchart illustrating an operation of the channel opening-and-closing mechanism at time of the circulation operation in the inkjet printer 1.

The circulation operation is periodically performed at predetermined time intervals at timings other than the timing at which the printing process is performed. The circulation operation can circulate the liquid ink held in the ink container 38 of the sub tank 35 to stir the liquid ink in the ink container 38. The circulation operation can prevent a compound in the liquid ink from being precipitated or coagulated that degrades property of the liquid ink.

The inkjet printer 1 includes a timer that operates to determine timing of the circulation operation at time of operation of the inkjet printer 1. Thus, the timer measures elapsed time since a previous circulation operation (WAIT). If the elapsed time does not exceed the predetermined time, the controller 500 does not executes the circulation operation and ends the circulation operation (NO in S801). If the elapsed time since the previous circulation operation exceeds the predetermined time (YES in S801), the controller 500 starts the circulation operation (S802).

To execute the circulation operation, the controller 500 drives the circulation solenoid 302 serving as the third channel opening-and-closing mechanism to connect (open) the circulation channel 45. Thus, the controller 500 connects (open) the circulation channel 45 between the outlet 207 of the ink container 38 and the ink cartridge 10. Specifically, the controller 500 connects (open) the tubes 37 (circulation channel 45) that connects the outlet 207 and the tube 36 connected at a position closer to the ink cartridges 10 than the liquid feed pump 241 as illustrated in FIG. 5. A certain amount of time is required from an operation of the circulation solenoid 302 (opening of circulation channel 45) to a completion of connection (communication) of the circulation channel 45 (S803).

Then, the controller 500 waits until the predetermined first waiting time has elapsed (S804). Details of the first waiting time is described below.

After the first waiting time has elapsed, the controller 500 drives the liquid feed pump 241 (S805). The liquid feed pump 241 is driven to feed the liquid ink in the ink container 38 of the sub tank 35 back to the identical ink container 38 through the tube 37, the circulation solenoid 302, the tube 36, and the liquid feed pump 241 constituting the circulation channel 45. Thus, the liquid ink circulates in the circulation channel 45. The controller 500 drives the liquid feed pump 241 for the predetermined time and then stops driving the liquid feed pump 241 (S806).

Then, the controller 500 waits for a predetermined time until a predetermined second waiting time has elapsed (S807). Details of the second waiting time is described below.

After the second waiting time has elapsed, the controller 500 operates the circulation solenoid 302 to disconnect (close) the circulation channel 45 between the ink cartridge 10 and the ink container 38 (S808).

A control of stopping the liquid feed pump 241 in the step S806 is not necessarily be limited to be executed after the predetermined time has elapsed. For example, the inkjet printer 1 may include a pressure sensor that detects an internal pressure of the supply channel 43. The controller 500 may stop the liquid feed pump 241 at timing when a pressure detected by the pressure sensor becomes equal to or less than a predetermined value.

[Relation Between Operation Timing of First Channel Opening-and-Closing Mechanism and Pressure in Supply Channel]

Figures 9, 10:
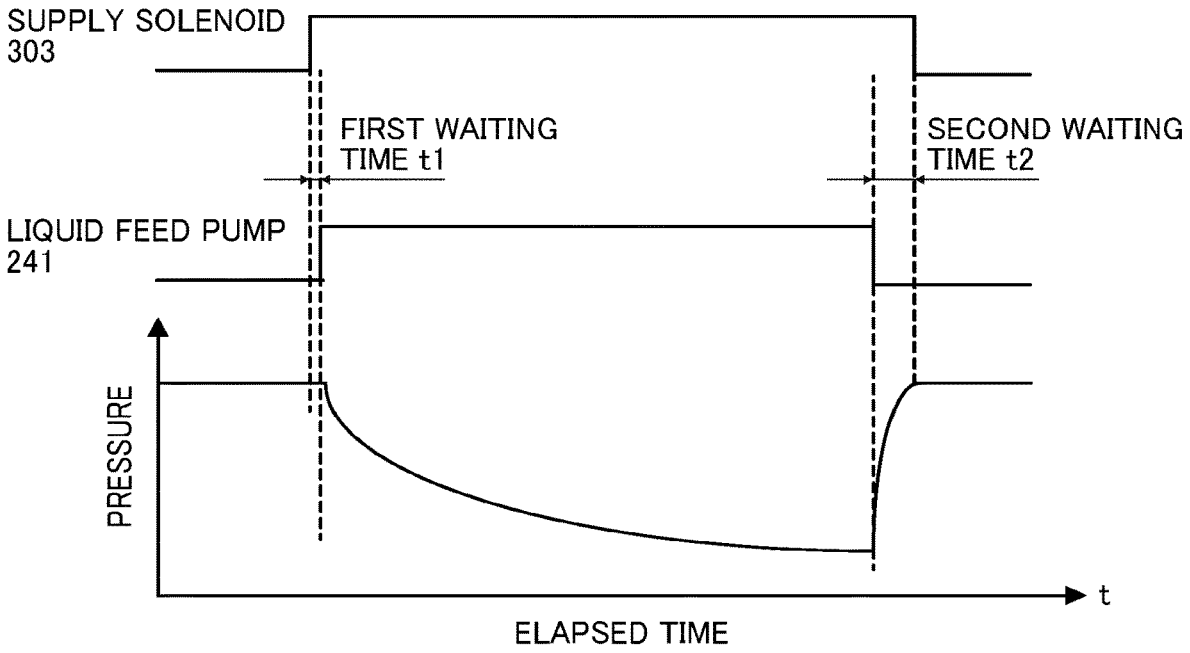
FIG. 9 is a graph illustrating an operation of the channel opening-and-closing mechanism and a pressure change in the channel of the inkjet printer according to the present disclosure.
FIG. 10 is a table illustrating a relation between a pressure in the channel and an amount of air mixed into the liquid ink in the channel of the inkjet printer.

Next, a relation between the operation timing of the channel opening-and-closing mechanism and the pressure in the channel 40 is described with reference to FIG. 9. The relation illustrated in FIG. 9 is obtained during performing a method of controlling the channel opening-and-closing mechanism as described-above in FIGS. 7 and 8 FIG. 9 is a graph of an example of the pressure changes in an upstream side of the liquid feed pump 241 (second channel opening-and-closing mechanism) during the ink supply operation.

In the configuration illustrated in FIG. 5, the controller 500 drives the supply solenoid 303 to connect (communicate) the supply channel 43 and waits for a passage of the "first waiting time (t1)" before driving the liquid feed pump 241. The "first waiting time (t1)" is approximately from 0.1 seconds to 1 second. The controller 500 operates the supply solenoid 303, secures complete connection (communication) of the supply channel 43 by the first waiting time (t1), and then drives the liquid feed pump 241. Thus, as illustrated in FIG. 9, the pressure in the supply channel 43 gradually changes after the start of the operation of the liquid feed pump 241.

If the controller 500 drives the liquid feed pump 241 before a complete connection (communicated) of the supply channel 43 is secured by operating the supply solenoid 303 (before the supply solenoid 303 is fully opened after operating the supply solenoid 303), the pressure in the supply channel 43 rapidly changes. Then, when the supply solenoid 303 is fully opened, the liquid ink flows from the ink cartridge 10 to the sub tank 35 to temporarily reduce the pressure change.

Then, the controller 500 operates the liquid feed pump 241 to gradually feed the liquid ink to the sub tank 35 to reduce (settle) the pressure change. To supply the liquid ink through the supply channel 43, it is important not to cause such a sudden (rapid) pressure change. Thus, the first waiting time (t1) is set so that the controller 500 start driving the liquid feed pump 241 after the supply solenoid 303 is fully opened (after the complete connection (communication) of the supply channel 43). Thus, the controller 500 can perform the ink supply operation including the first waiting time (t1) to prevent the pressure in the supply channel 43 to rapidly become negative.

The liquid feed pump 241 is stopped after being driven for a predetermined time, and the liquid feed pump 241 then drives for a predetermined time (S705) and then stops driving (S706). After the liquid feed pump 241 is stopped, the negative pressure in the supply channel 43 gradually reduces. Thus, "second waiting time (t2)" is set to close the supply solenoid 303 at the time when the pressure in the supply channel 43 returns to an original pressure.

Time taken for the pressure in the supply channel 43 to return to the original pressure is measured in advance to obtain the second waiting time (t2). The second waiting time (t2) is stored in the NVRAM 504 of the controller 500. The controller 500 controls the timing to close the supply solenoid 303 using the second waiting time (t2) stored in the NVRAM 504. The second waiting time (t2) is approximately from one to five seconds. The second waiting time is varied according to fluid resistance of the supply channel 43 or a state of the pressure in the supply channel 43 during driving the liquid feed pump 241.

The ink cartridge 10 is disposed above the liquid feed pump 241 in a vertical direction in the inkjet printer 1. The above-described arrangement of the ink cartridges generates a water head difference between the ink cartridge 10 and the liquid feed pump 241 that applies a positive pressure to the supply channel 43. The above-described positive pressure enable the pressure in the supply channel 43, which has once become negative, easily to be close to zero by the above-described procedure.

Further, the positive pressure affects to shorten the second waiting time (t2) necessary for the pressure in the supply channel 43 to return to the original pressure. Further, instead of using the elapse of the second waiting time (t2) as a trigger to close the supply solenoid 303, the pressure sensor disposed in the supply channel 43 may be used to detect timing when the pressure in the supply channel 43 detected by the pressure sensor becomes equal to or smaller than a predetermined pressure. The detected timing by the pressure sensor may be used as a trigger to close the supply solenoid 303.

According to the inkjet printer 1 according to the present embodiment described above, the gas barrier property in the supply channel for supplying the liquid ink to the sub tank 35, the tube 36 and the ink cartridge 10 constituting the supply channel, the delivery It is possible to prevent air mixing due to the sealing property of the joint portion of the liquid feed pump 241 and the sub tank 35. Further, the inkjet printer 1 can prevent air to enter and mix to the liquid ink in the channel 40 without using materials having higher gas barrier property and without using highly accurate joint parts.

[Relation Between Pressure in Channel and Amount of Mixed Air]

Next, a relation between the pressure in the channel 40 and an amount of air mixed into the liquid ink in the channel 40 is described with reference to FIG. 10. When the pressure in the channel 40 is a negative pressure, the larger an absolute value of the pressure in the channel 40, the larger the amount of air permeating through the tube 36 or the like that constitutes the channel 40 and entering into the channel 40. That is, the stronger the negative pressure, the stronger the channel 40 tries to take air into the channel 40, and the larger the amount of air mixed into the liquid ink in the channel 40.

The amount of air mixed into the channel 40 may differ according to the gas barrier property of the material used in the tube 36 and a sealing property owing to the accuracy of the joint parts. In other words, if the pressure in the channel 40 is controlled to be closed to zero as possible, it is not necessary to improve gas barrier property of the tube 36. Further, it is not necessary to use a high precision joint part to prevent air entered and mixed from the joint part. Thus, a manufacturing cost of the inkjet printer 1 can be greatly reduced.

Thus, the inkjet printer 1 according to the present embodiment controls the operation timing of the channel opening-and-closing mechanism that configures the channel 40 as described above. Thus, the pressure in the channel 40 is controlled to be closed to zero as much as possible at normal times other than the time when the liquid ink is flown in the channel 40. Thus, the above-described pressure control can prevent air from being mixed into the ink container 38 of the sub tank 35.

Generally, the tube 36 and 37 having higher gas barrier property include a multilayer structure that includes a barrier layer between an innermost layer and an outermost layer. In case in which the pressure in the channel 40 is a positive pressure greater than zero, the joint parts have to be highly accurate to discharge the liquid ink in the supply channel 43 outside the supply channel 43. In this respect, the inkjet printer 1 according to the present disclosure can prevent the air to be mixed into the channel 40 without increasing the gas barrier property of the material of tubes 36 and 37 or increasing the accuracy of the joint parts.

Embodiments of Liquid Discharging Apparatus, Liquid Discharge Device, Liquid Discharge Head The inkjet printer 1 described above in the present disclosure is also referred to as a "liquid discharge apparatus". The "liquid discharge apparatus" is a device including the head (liquid discharge head) or a liquid discharge device. The liquid discharge apparatus drives the head to discharge the liquid. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "sheet 42" used in the above-described embodiments include recording media, such as paper sheet, recording paper, recording sheet of paper, film, and cloth, electronic part, such as electronic substrate and piezoelectric element, and media, such as powder layer, organ model, and testing cell. The "sheet 42" includes any material on which liquid is adhered, unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The recording head 34 is an example of the liquid discharge head and is a functional component to discharge liquid from the nozzles of the liquid discharge head. Liquid to be discharged from the nozzles of the head is not limited to a particular liquid as long as the liquid has a viscosity or surface tension to be discharged from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication. Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The pressure generator used in the "liquid discharge head" is not limited to a particular-type of pressure generator. The pressure generator is not limited to the piezoelectric actuator (or a laminated-type piezoelectric element) described in the above-described embodiments, and may be, for example, a thermal actuator that employs a thermoelectric transducer element, such as a thermal resistor or an electrostatic actuator including a diaphragm and opposed electrodes.

The liquid discharge device as described above includes the recording head 34, the carriage 33 on which the recording head 34 is mounted, and assembly of parts to perform image formation with the ink droplets discharged from the recording heads 34 while slidably moving the carriage 33.

The term "liquid discharge device" represents a unit in which the head and other functional parts or mechanisms are combined, in other words, an assembly of parts relating to the liquid discharge function. For example, the "liquid discharge device" includes a combination of the head with at least one of a sub tank, a carriage, a supply unit, a maintenance unit, and a main scan moving unit.

Examples of the "single unit" include a combination in which the head and one or more functional parts and devices are secured to each other through, e.g., fastening, bonding, or engaging, and a combination in which one of the head and the functional parts and devices is movably held by another. The head may be detachably attached to the functional part(s) or unit(s) s each other.

For example, the head and the sub tank may form the liquid discharge device as a single unit. In the inkjet printer 1 described above, the head 34 and the sub tank 35 are connected with the tube 36 to form a single unit. Here, a unit including a filter may further be added to a part between the sub tank 35 and the head 34.

In another example, the liquid discharge device may include the head and the carriage forming a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of a maintenance unit may be secured to the carriage mounting the head so that the head, the carriage, and the maintenance unit form a single unit to form the liquid discharge device.

Further, in another example, the liquid discharge device includes tubes connected to the sub tank or the channel member mounted on the head so that the head and the supply assembly form a single unit. Liquid is supplied from a liquid reservoir source to the head via the tube.

The main scan moving unit may be a guide only. The supply assembly may include only a tube(s) or a loading unit.

Although the preferred embodiments of the present disclosure have been described above, the present disclosure is not limited to the embodiments described above, and a variety of modifications can naturally be made within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA) and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus, comprising:

a liquid discharge head configured to discharge a liquid;

a sub tank configured to hold the liquid to supply the liquid to the liquid discharge head:

a liquid cartridge configured to hold the liquid to be supplied to the sub tank;

a supply channel configured to connect the sub tank and the liquid cartridge to supply the liquid from the liquid cartridge to the sub tank in a supply direction;

a first channel opening-and-closing mechanism disposed in the supply channel to switch connection and disconnection of the supply channel;

a second channel opening-and-closing mechanism disposed downstream of the first channel opening-and-closing mechanism in the supply direction in the supply channel; and circuitry configured to operate the first channel opening-and-closing mechanism to connect the supply channel;

wait until a first predetermined waiting time has elapsed after connection of the supply channel and then operate the second channel opening-and-closing mechanism to feed the liquid from the liquid cartridge to the sub tank;

stop an operation of the second channel opening-and-closing mechanism; and wait until a second predetermined waiting time has elapsed after stopping the second channel opening-and-closing mechanism and then operate the first channel opening-and-closing mechanism to disconnect the supply channel, wherein the first predetermined waiting time is different from the second predetermined waiting time.

2. The liquid discharge apparatus according to claim 1, wherein the liquid cartridge is disposed above the second channel opening-and-closing mechanism.

3. The liquid discharge apparatus according to claim 1, wherein the circuitry is further configured to control timing of starting an operation of the first channel opening-and-closing mechanism to connect the supply channel to be before starting an operation of the second channel opening-and-closing mechanism.

4. An image forming apparatus comprising:

the liquid discharge apparatus according to claim 1, wherein the liquid discharge apparatus is configured to reciprocally move the liquid discharge head while driving the liquid discharge head to discharge the liquid onto a recording medium to form an image on the recording medium.

5. The liquid discharge apparatus of claim 1, wherein the circuitry is further configured to wait until the first predetermined waiting time has elapsed after connection of the supply channel, and wait until the second predetermined waiting time has elapsed after stopping the second channel opening-and-closing mechanism, wherein the second predetermined waiting time is longer than the first predetermined waiting time.

6. A liquid discharge apparatus comprising:

a liquid discharge head configured to discharge a liquid;

a sub tank configured to hold the liquid to supply the liquid to the liquid discharge head;

a liquid cartridge configured to hold the liquid to be supplied to the sub tank;

a supply channel configured to connect the sub tank and the liquid cartridge to supply the liquid from the liquid cartridge to the sub tank in a supply direction;

a circulation channel configured to connect the sub tank and the supply channel to return the liquid held in the sub tank to the supply channel;

a first channel opening-and-closing mechanism disposed in the supply channel to switch connection and disconnection of the supply channel;

a second channel opening-and-closing mechanism disposed downstream of the first channel opening-and-closing mechanism in the supply direction in the supply channel;

a third channel opening-and-closing mechanism disposed in the circulation channel to connect and disconnect the circulation channel; and circuitry configured to operate the first channel opening-and-closing mechanism to disconnect the supply channel;

operate the second channel opening-and-closing mechanism to circulate the liquid in the sub tank via the circulation channel and the supply channel;

operate the third channel opening-and-closing mechanism to connect the circulation channel;

wait until a waiting time has elapsed after connection of the circulation channel and then operate the second channel opening-and-closing mechanism to circulate the liquid in the sub tank via the circulation channel and the supply channel;

stop the operation of the second channel opening-and-closing mechanism; and wait until another waiting time has elapsed after stopping the second channel opening-and-closing mechanism and then operate the third channel opening-and-closing mechanism to disconnect the circulation channel, wherein the waiting time is different from the another waiting time.

7. The liquid discharge apparatus according to claim 6, wherein one end of the circulation channel is connected to the sub tank, and another end of the circulation channel is connected to the supply channel between the first channel opening-and-closing mechanism and the second channel opening-and-closing mechanism.

8. The liquid discharge apparatus according to claim 6, wherein the circuitry is further configured to periodically perform a circulation operation that connects the circulation channel and circulates the liquid in the sub tank at predetermined time intervals.

9. The liquid discharge apparatus according to claim 6, wherein the circuitry is further configured to:

operate the third channel opening-and-closing mechanism to connect the circulation channel;

wait until a waiting time has elapsed after connection of the circulation channel; and operate the second channel opening-and-closing mechanism to circulate the liquid in the sub tank via the circulation channel and the supply channel.

10. The liquid discharge apparatus according to claim 9, wherein the circuitry is further configured to:

stop an operation of the second channel opening-and-closing mechanism;

wait until another waiting time has elapsed after stopping the second channel opening-and-closing mechanism; and operate the third channel opening-and-closing mechanism to disconnect the circulation channel.

11. A liquid discharge apparatus, comprising:

a liquid discharge head configured to discharge a liquid;

a sub tank configured to hold the liquid to supply the liquid to the liquid discharge head;

a liquid cartridge configured to hold the liquid to be supplied to the sub tank;

a supply channel configured to connect the sub tank and the liquid cartridge to supply the liquid from the liquid cartridge to the sub tank in a supply direction;

a pressure sensor disposed in the supply channel and configured to detect pressure in the supply channel;

a first channel opening-and-closing mechanism disposed in the supply channel to switch connection and disconnection of the supply channel;

a second channel opening-and-closing mechanism disposed downstream of the first channel opening-and-closing mechanism in the supply direction in the supply channel; and circuitry configured to operate the first channel opening-and-closing mechanism to connect the supply channel;

wait until a first predetermined waiting time has elapsed after connection of the supply channel and then operate the second channel opening-and-closing mechanism to feed the liquid from the liquid cartridge to the sub tank;

stop an operation of the second channel opening-and-closing mechanism; and wait until the pressure detected by the pressure sensor reaches a predetermined pressure after stopping the second channel opening-and-closing mechanism, and then operate the first channel opening-and-closing mechanism to disconnect the supply channel.

* * * * *